United States Patent [19]

Sternheimer

[11] 4,003,299

[45] Jan. 18, 1977

[54] PACKING SYSTEM

[75] Inventor: Michael Sternheimer, Pavillonstrasse, Germany

[73] Assignee: Astra-Werke GmbH Druck & Verpackung, Saarlouis, Germany

[22] Filed: Mar. 27, 1975

[21] Appl. No.: 562,558

[30] Foreign Application Priority Data

Apr. 18, 1974 Germany ..... 2418694

[52] U.S. Cl. ..... 93/49 M; 93/33 R; 93/52; 93/55

[51] Int. Cl.[2] ..... B31B 1/26; B31B 17/00

[58] Field of Search ..... 93/49 M, 49 R, 52, 39 R, 93/55, 33 R

[56] References Cited

UNITED STATES PATENTS

| | | | |
|---|---|---|---|
| 1,750,717 | 3/1930 | Laube | 93/55 |
| 2,625,085 | 1/1953 | Bergstein | 93/55 |
| 3,626,660 | 12/1971 | Dorfmann | 93/52 X |
| 3,768,380 | 10/1973 | Stark | 93/55 X |

*Primary Examiner*—Leon Gilden
*Attorney, Agent, or Firm*—Paul J. Sutton

[57] ABSTRACT

In a method of making boxes with flap tops or push-on lids from flat carton blanks, two opposed side flaps of the lid blank are provided with adhesive, the base blank is pushed below the lid blank at a spacing at least equal to the height of the side flaps, two corresponding side flaps of the base blank are folded up at right-angles, the said two side flaps of the lid blank are folded down onto the upstanding side flaps of the base blank and adhered thereto, two further opposed side flaps of the base blank are bent upwardly, two corresponding further side flaps of the lid blank are provided with adhesive and folded down onto and adhered to the said further side flaps of the base blank, the interconnected completed base and lid of the box have a paper covering adhered over them, and an incision is made for severing at least three of the side flaps of the lid.

12 Claims, 3 Drawing Figures

PACKING SYSTEM

The invention relates to a method of making boxes with flap tops on push-on lids from carton blanks which form the lid and base portions and which, after being erected, glued and joined, are provided with a paper covering and scored or incised along the edges of the opening of the lid, as well as to an apparatus for carrying out this method.

To make flap top boxes such as for packaging cigarillos, it is known first of all to fold the lid from a lid blank having side flaps which extend from the sides of the lid, to unfold the base portion from a base blank having attached side flaps, and to fold from a strip of cardboard, of which the width is equal to the internal height of the box, a neck portion of which the abutting ends are interconnected by stack-on paper strips, all in separate production lines. In the known method, the production lines for making the base and neck portion first of all meet up so that the neck portion of which the outside is provided with a peripheral application of adhesive at the bottom is inserted into the base portion and the vertically set side flaps of the base are pressed against the inserted glued neck portion. The lid portion with vertically set side flaps is then supplied from the third production line and placed over the neck portion so that the vertically set side flaps of the base and neck portions abut one another. The height of the abutting vertically set side flaps corresponds to the height of the box. The assembled box is subsequently provided with a paper covering which is folded from a flat blank. Only the underface of the box is excluded from the paper covering. The box prefabricated in this manner is then stored so that the adhesives used may set and dry out. Subsequently the boxes are fed to a cutting apparatus in which the paper covering is cut open along three sides of the box along the lines of abutment of the side flaps of the cover and base forming the side portions of the box. The paper covering which is unsevered on the fourth side of the box forms the hinge for the box about which the lid that is pushed over the neck portion can be swung.

The known method is neither fully automatic nor operates continuously. To make boxes by the known method numerous workers are required, whose wages make the boxes more expensive.

It is the aim of the present invention to suggest a method by which boxes with flap tops or push-on lids can be continuously produced in a more rational and fully automatic manner.

In a method of the aforementioned kind, this aim is fulfilled according to the invention in that the lid consisting of side flaps that project beyond the top is provided with a quick-setting adhesive, preferably a hot-melt adhesive, in the region of the end margins of two opposed side flaps, that the base portion consisting of the side flaps projecting beyond the base is pushed under the lid at a spacing at least equal to the height of the side portions and is aligned in registry with the lid, that the side flaps of the base portion underlying the glued side flaps of the lid are erected to a vertical position, that the glued side flaps of the lid are folded onto the upstanding side flaps of the base portion and pressed thereagainst, that the two as yet flat side flaps of the base portion are erected, that the as yet flat side flaps of the lid are provided with a quick-setting adhesive in the region of their end margins, that the glued side flaps of the lid are folded onto the upstanding side flaps of the base portion, and that the closed base, after having a paper covering adhered to it, is provided along the edges of the opening with an opening incision which severs the outer side flaps of the lid. The method of the invention permits boxes with flap tops or push-on lids to be produced continuously in one production line. The method of the invention is particularly advantageous over the conventional method because the box portion according to the invention is made from only two carton blanks without covering. The two carton blanks are substantially identical. For the lid portion with attached side flaps it is merely necessary to take into account that this is pushed over the lower portion having the upstanding side flaps, so that the blank for the lid portion must be appropriately larger by the thickness of the cardboard.

The height of the side flaps of the lid and base portions corresponds to the height of the side walls of the box. Before the box with paper covering is cut open, the side walls consist of a double layer of cardboard. By cutting the box open along a line extending parallel to the edges of the lid or base portion in the central or upper region over the side flaps of the lid portion, the lid can be severed from the lower strip of side flaps that includes the upstanding side flaps of the base portion in the lower region and is adhered thereto. The upstanding side flaps of the base portion project beyond this remaining strip of cardboard and form a neck which stiffens the box and on which the lid portion can be placed.

In the manufacture of push-on lids, the incision severing the lid is made along all four side walls.

In the manufacture of flap top boxes, the side flap of the lid portion at which the hinge will later be located is provided with a continuous incision or an incision that is interrupted by web portions, before the box is provided with a paper covering. After the paper covering has been provided on the box, the latter is then provided with a severing cut that extends along the side portions of the box except at the side of the hinge, so that the paper covering forms the hinge in the region of the side flap that had previously been provided with a severing cut, it being possible to open the flap top box about this hinge.

Glueing of the side flaps takes place with a hot-melt adhesive which sets very rapidly and therefore permits the continuous manufacture of boxes at a high production rate by the method of the invention. The application of adhesive takes place only on the part of the side flaps disposed beneath the subsequent line of cut that severs the lid, whereby the side portions of the lid will not become stuck to the side flaps of the base portion forming the inner neck.

Preferably, in the manufacture of flap top boxes the side flaps of the lid which are disposed on the hinge side and which may be prescored or provided with an incision that is interrupted by web portions are provided with a throughgoing severing cut before the paper covering is glued on, so that the hinge is formed only by the paper covering and the flap top box can be opened more easily.

It is also desirable for the side flaps of the lid to be prescored in the region of the subsequent severing cut so that the subsequent severing cuts can be carried out more easily.

The apparatus for carrying out the method of the invention is characterised in accordance with the invention by two parallel guide rails with planar tops and having their outer edges spaced apart corresponding to the interior box length or width, two further guide rails extending parallel to the first guide rails at a spacing equal to the height of the side flaps of the lid, a conveyor which extends through the first guide rails and has spaced means for carrying along lid blanks lying thereon, means disposed between the respective guide rails for applying adhesive to the outer regions of those side flaps of the lid which are laterally disposed as viewed in the conveying direction, means for inserting base blanks onto a guide which is disposed under the first guide rails and which is traversed by the means for carrying along the blanks, means downstream thereof provided with run-up faces for folding onto the vertical outer side of the first guide rail those side flaps of the base blank that are laterally disposed as viewed in the conveying direction, means downstream thereof and provided with run-up faces for folding the glued side flaps of the lid down onto the upstanding side flaps of the base, means for pressing the folded side flaps of the lid and base onto one another, means for turning through 90° in the conveying direction the lid and base portions that are adhered to each other at two opposed side flaps, means downstream of the turning means for erecting those side flaps of the base blank that are disposed laterally as viewed in the conveying direction, for glueing the outer regions of the as yet flat side flaps of the lid and for pressing the glued side flaps of the lid against the upstanding side flaps of the base.

Preferably, a magazine for the lid blanks is provided upstream of the first guide rails and have a lower slot through which an intermittently driven slide pushes the blanks onto the first guide rails. The withdrawal of the blanks from the magazine can also take place by means of suction caps or in some other manner. A preferably grooved feed roller may be provided between the magazine and the conveyor for reliably transferring the blanks to the continuously operating conveyor.

The adhesive applicator means for the hot melt adhesive may consist of spray nozzles or adhesive applicator wheels.

Preferably, a second magazine for the base blanks disposed at right-angles to the guide rails is provided with means for inserting the base blanks below the guide rails.

The pressing means may consist of two respective parallel rows of small rollers. The inner row of rollers is preferably arranged in a recess of the guide rails.

The conveyor means disposed between the guide rails may terminate upstream of the pressing means and further conveying may be by way of faster second conveyor means having lateral fingers engaging behind the vertical side flaps disposed between the lid and base portions. This arrangement is also desirable for improved centering because both lateral side flaps have the same length corresponding to the width of the box so that good centering of the lid and base portions is possible.

In a further development of the invention the means for turning the lid and base portions that are glued to one another by two opposed side flaps may consist of a conveyor at right-angles downstream of the pressing means, this conveyor taking over further conveying in a 90° rotated position. In this position the side portions that are not yet folded and glued lie laterally of the conveying direction so that the necessary treatment may be carried out.

Between the pressing means and the conveyor adjoining at right-angles there may be a feed roller which, on changing the direction, ensures clean transfer of the partially glued blanks to the subsequent conveyor. The conveyor that is at right-angles is desirably provided with lateral guides which take over the guiding function during folding and glueing of the as yet flat side flaps.

An example of the invention will now be described in more detail with reference to the drawing, wherein.

Figure 1:
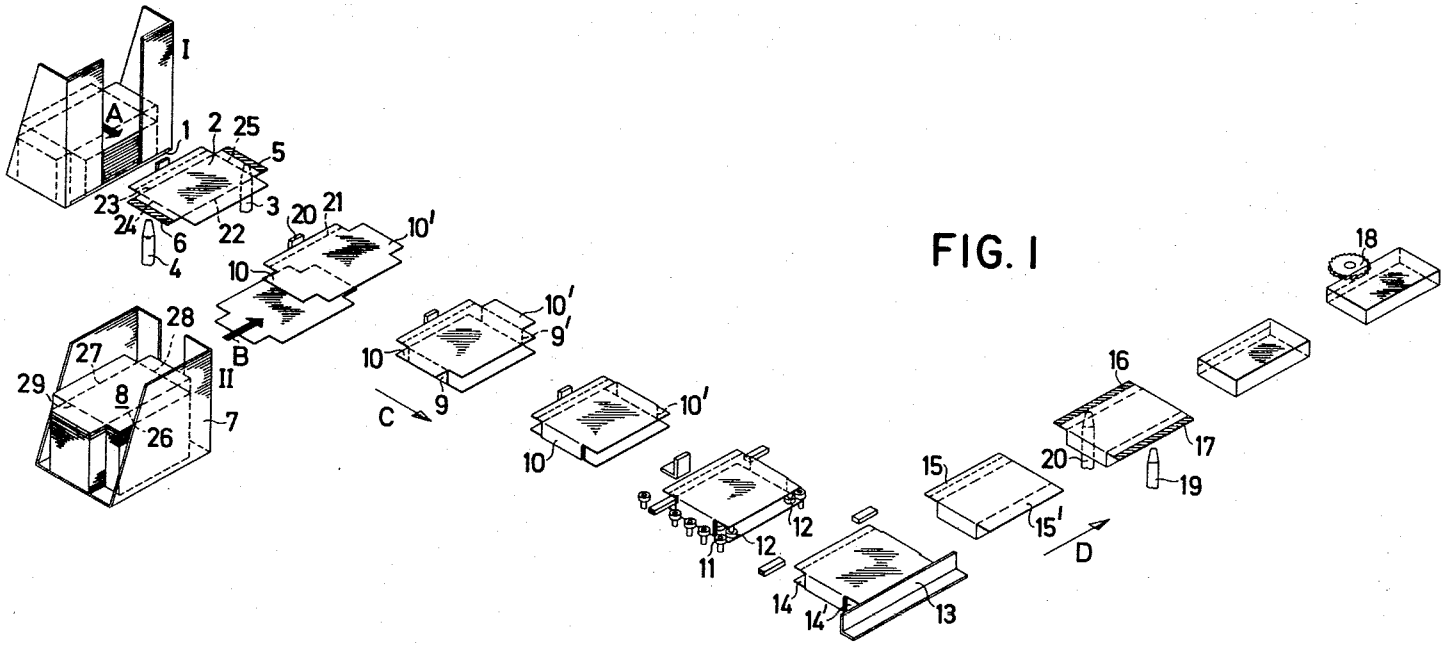
FIG. 1 is a diagrammatic representation of the method that has been divided up into the individual method steps.

The method of making boxes with flap tops or push-on lids will first of all be explained with reference to FIG. 1. The lid blanks 2 withdrawn from the magazine 1 having the base slot 1' are provided with a coating of hot-melt adhesive on the undersides of the side flaps 10, 10' at the regions 5 and 6 indicated by cross-hatching. This coating of hot-melt adhesive is sprayed on by the adhesive nozzles 3, 4 which are controlled by micro-switches or photocells (not shown). The carton blank 2 is then further conveyed in the direction of the arrow C. A base blank 8 is withdrawn in an analogous manner from the magazine 7 and pushed below the lid blank 2 in the direction of the arrow B. The dog 20 fixed to a conveyor chain takes both blanks along and aligns them so that they are superposed in registry.

The side flaps 9, 9' of the base blank 8 that are disposed laterally as viewed in the conveying direction are then erected to the vertical position.

The side flaps 10, 10' of the lid blank that are disposed laterally as viewed in the conveying direction are then folded down onto the upstanding side flaps 9, 9' of the base and pressed thereagainst. Pressing may be effected by the parallel rows 11, 12 of small rollers. The lid and base portions that are adhered to one another by two opposed side flaps then change their conveying direction by 90° so that the as yet flat side portions are disposed laterally to the new conveying direction D. After changing the conveying directon relatively to the interconnected lid and base portions, the side flaps 14, 14' of the base are first of all erected to a vertical position. The side portions 15, 15' of the lid are then provided at the underside along the cross-hatched regions 16, 17 with a quick-setting adhesive coating. For this purpose a hot-melt adhesive may be sprayed through the nozzles 19, 20. The side flaps 15, 15' of the lid portion are then folded onto the upstanding side portions 14, 14' of the base and pressed thereagainst. The glued box thus formed and not yet provided with a paper covering is subsequently finished at downstream treating stations which are traversed continuously. In the case of making flap top boxes, the side flap 15 of the lid blank 2 can be severed by the circular knife 18 along the pre-cut line 21 that is interrupted only by webs of material. The circular knife 18 cuts only through the webs of material remaining between the throughgoing cuts. It is so set that the side flap 14 of the base blank is not also cut or scored.

The apparatus can also be constructed so that the method is performed with the lid portion lying at the bottom and the base portion at the top.

Further, the adhesive coatings could be applied to appropriate parts of the side flaps of the base blank instead of to the side flaps of the lid blank.

The side flaps 10, 10' and 15, 15' of the lid blank are separated from the lid portion itself by means of fold lines 22, 23, 24, 25. Similarly, the side flaps 9, 9' and 14, 14' of the base blank are separated from the base portion by fold lines 26, 27, 28, 29. The fold lines themselves are desirably formed by lines of cut or score lines that weaken the material.

The apparatus for making the boxes with flap tops or push-on lids comprises magazines 1 and 7 in which the lid blanks 2 as well as the base blanks 8 are inserted. The magazine 1 is disposed transversely in front of the start of parallel guide rails 31, 32, the spacing between the outer edges of the guide rails corresponding to the internal length or width of the box. The guide rails 31, 32 are of rectangular cross-section so that the side flaps of the lid and base blanks can be folded around them at right-angles. A conveyor chain 30 for which the sprockets and drives are not illustrated extends between the guide rails 31, 32. The conveyor chain is provided at intervals with dogs 20 for transporting the blanks that are supplied above and below the guide rails 31, 32.

Figures 2, 3:
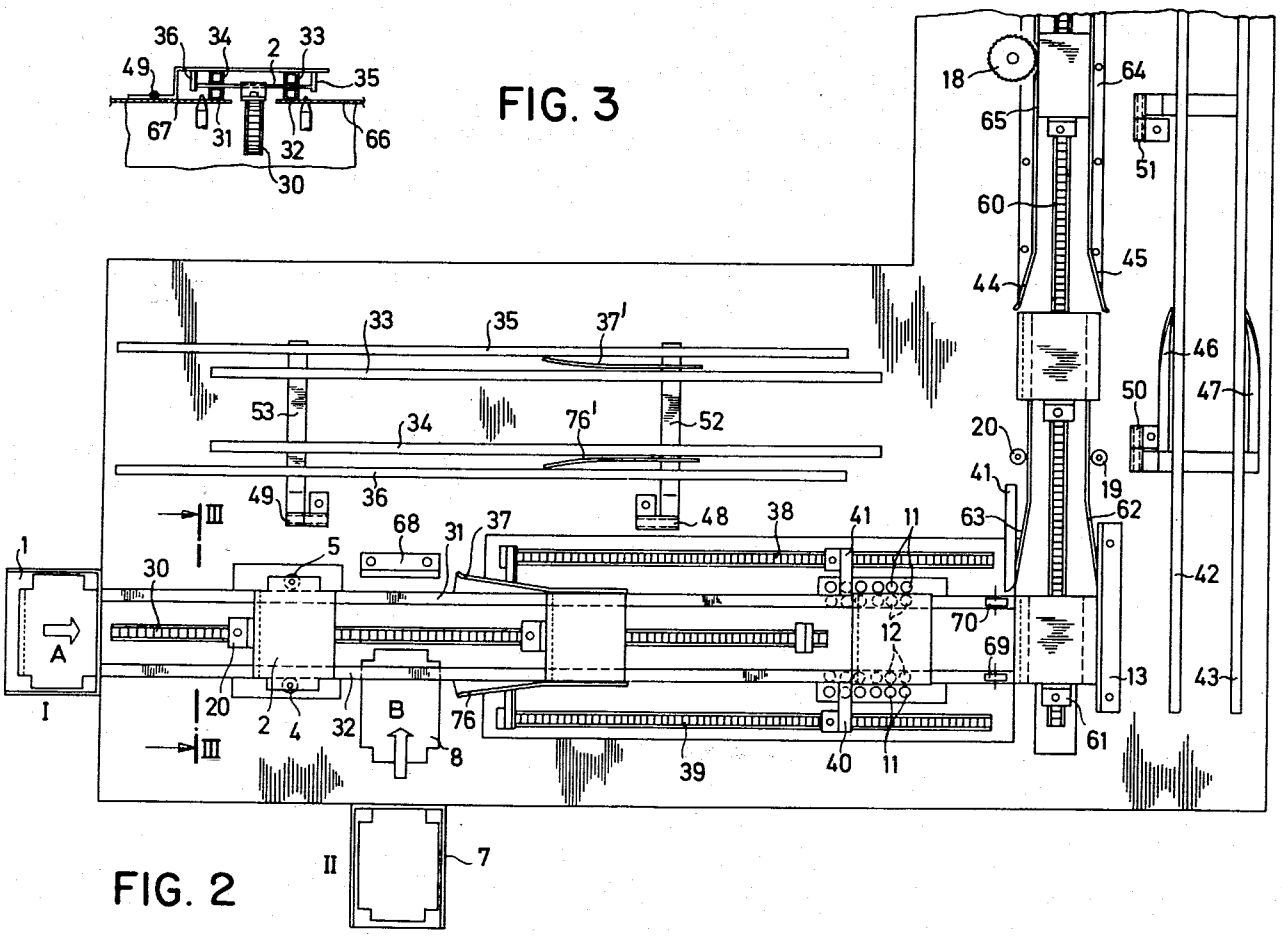
FIG.2 is a diagrammatic plan view of an apparatus for performing the method.
FIG. 3 is a section on the line III—III in FIG. 2.

The lid blanks 2 are transported onto the guide rails 31, 32 in the direction of the arrow A by means of slides or suction caps (not shown). Parallel to the guide rails 31, 32 that are lateral rails 35, 36 which are fixed to supports 52, 53 that are pivotable about hinges 48, 49. In FIG. 2, the apparatus is illustrated in the open condition in which the guides 35, 36 are swung out of the position at which they surround the guide rails 31, 32. Further guide rails 33, 34 are mounted on the supports 52, 53; when they are swung closed, these further guide rails extend above the rails 31, 32 at a spacing equal to the thickness of the cardboard.

The adhesive applicator nozzles 4, 5 are arranged in the front region of the conveyor 30 between the guide rails 35 and 32 on the one hand as well as 31 and 36 on the other hand.

Associated with the laterally disposed magazine 7 for the base blanks 8 there are suction caps or slide means which push each lowermost blank from a base slot of the magazine in the direction of the arrow B onto a guide (not shown) disposed below the guides 31, 32. The lateral guide 35 is not interrupted in the push-in region of the base blank 8. The blank 8 is advanced until the leading edge of its side flap 9' strikes the abutment 68. The base blank 8 is then carried along by the dog 20 in registry with the lid blank lying on the guides 31, 32. The height of the guides 31, 32 corresponds to the height of the box and thus to the height of the side flaps 10, 10' and 9, 9'.

Folding plates 76, 37 provided with run-up faces are fixed to the frame downstream of the magazine 7 to fold the side flaps 9, 9' of the base against the guide rails 31, 32 and stand them up. By means of the folding plates 76', 37' which are provided with run-up faces and mounted on the pivotable support 52, the glued side flaps 10, 10' of the lid blank are then folded onto the upstanding side flaps of the base.

Lateral conveyor chains 38, 39 provided with fingers 40, 41 extend parallel to the conveyor chain 30. The lateral conveyor chains run synchronously and at a faster speed than the chain 30. The lateral fingers 40, 41 engage the rear edges of the upstanding side flaps laterally and convey the blanks at a higher speed so that the abutment 20 is released and can dip off. The fingers 40, 41 then convey the blanks through the pressing station in which parallel rows of small rollers 11, 12 tightly press the side flaps together in the region of the adhesive coating. The conveyor chains 38, 39 feed the blanks onto the feed rollers 69, 70. The latter convey the blanks at a faster speed away from the fingers 40, 41 so that the latter can dip off. The feed roller takes the blanks up to the abutment 13 disposed at right-angles to the conveying direction of the chains 30, 38, 39.

At right-angles to the conveyor chains 30, 38, 39 there is a further chain conveyor 60 provided at intervals with dogs 61. By means of these dogs the chain conveyor 60 takes along the blanks that are adhered to one another and deposit it in front of the abutment 13, the conveying direction being changed by 90°. At first, guiding is taken over by the abutment 13 and the guide rail 41 on the opposite side. The guides 42, 43, which are shown in the swung open position about hinges 50, 51 in FIG. 2, lie on the lid portion. Downstream of the abutment 13 there are lateral folding plates 62, 63 with run-up faces for erecting the side flaps of the base blank that extend laterally in the new direction of conveying. Downstream of the folding plates 62, 63 there are adhesive applicator nozzles 19, 20 which provide a coating of adhesive to the underside of the as yet flat side flaps of the lid portion. The glued lateral side flaps are then pressed against the upstanding lower side flaps by the folding plates with run-up faces 46, 47, 44, 45. Subsequently, the blanks that are now adhered to one another to form a box are guided by the lateral plates 64, 65. The circular knife 18 projects through a slot-shaped lateral aperture of the guide 65 and cuts open the corresponding side flap of the lid portion along a line. Following the apparatus shown in FIG. 2 there is a conveyor (not shown) for taking the boxes to subsequent treating stations at which they are provided with a paper covering, then cut open along their lines of opening, folded open and then closed again.

The cross-section of FIG. 3 shows the position of the guide rails fixed to the supports 52, 53 when swung onto the guide rails 31, 32. The lid blank 2 is pushed by the dogs 20 between the guide rails 31, 32 and 33, 34, the lateral boundary being formed by the guide rails 35, 36. Fixed to the frame below the guide rails 31, 32 there are the table plates 66, 67 which guide the base blanks 8 pushed out of the magazine 7.

In the region of the conveyor 60 the glued blanks also lie on a table which is fixed to the frame and on which they are displaced with lateral guiding.

I claim:

1. A method of making boxes from carton blanks, of the type having either flap tops or push-on lids and which after being formed and covered with paper are incised along edges of the box lid opening, comprising the steps of: adding a substantially quick-settling adhesive to and margins of opposed side flaps of a lid carton blank; positioning a base carton blank in aligned registered disposition beneath the lid carton blank and spaced therefrom a predetermined distance corresponding to the width of the finished box; erecting to a substantially vertical positon side flaps of the base carton blank underlying the lid side flaps carrying adhesive; folding the lid side flaps carrying adhesive to and into pressed engagement with the vertical base side flaps; erecting to a substantially vertical position the remaining side flaps of the base carton blank; adding said adhesive to end margins of the remaining side flaps of the lid carton blank; folding the remaining lid side flaps to and into pressed engagement with the remaining vertical base side flaps, thereby forming a closed box; applying a paper covering to the closed box; and incizing and severing the outer side flaps of the box lid at predetermined locations.

2. The method of claim 1, wherein said incizing is performed prior to the application of the paper covering.

3. The method of claim 2, wherein said incizing forms a plurality of incisions interrupted by web portions.

4. The method of claim 1, including the further step of prescoring the lid side flaps to be incised.

5. Apparatus for forming boxes having either flap tops or push-on lids from lid and base carton blanks, comprising, in combination: A first pair of substantially parallel guide rails with planar tops and having outer edges thereof spaced apart a distance corresponding to an interior dimension of a box to be formed, a second pair of guide rails extending substantially parallel with respect to the first pair of guide rails and spaced from one another a distance corresponding to the height of side flaps of a lid of a box to be formed, a conveyor which extends through the first pair of guide rails, spaced means on said conveyor for carrying box lid blanks thereon, means disposed between each pair of the respective guide rails for applying adhesive to portions of box lid side flaps, a box base blank guide, means disposed under the first pair of guide rails for inserting base blanks on to said box base guide in a direction traversed by the spaced carrying means, means downstream of said inserting means provided with run-up faces for folding side flaps of a box base blank onto vertical outer sides of the first pair of guide rails, means downstream of said folding means and provided with run-up faces for folding glued side flaps of a box lid onto upstanding side flaps of the box basem means for pressing the folded side flaps of the lid and base onto one another, means for turning through substantially 90° in the conveying direction the lid and base box portions, and means downstream of the turning means for erecting side flaps of the box base blank and for gluing portions of the box lid side flaps and further for pressing the glued box lid side flaps against the side flaps of the box base.

6. Apparatus according to claim 5, further comprising a magazine for holding box lid blanks at a location upstream of said first pair of guide rails, said magazine having a lower slot through which box lid blanks are pushed onto said first pair of guide rails.

7. Apparatus according to claim 6, further comprising feed rollers disposed between said magazine and said conveyor.

8. Apparatus according to claim 5, wherein said means for applying adhesive includes a plurality of spray nozzles.

9. Apparatus according to claim 5, wherein said means for applying adhesive comprises a plurality of applicator wheels.

10. Apparatus according to claim 6, further comprising means for inserting box base blanks below said first pair of guiderails.

11. Apparatus according to claim 5, wherein said means for pressing the glued box lid side flaps against the side flaps of the box base comprise two respective parallel rows of rollers.

12. Apparatus according to claim 5, wherein said conveyor means includes a second conveying portion thereof having lateral fingers capable of engaging rear wood portions of vertical box side flaps disposed between the box lid and the box base portions.

* * * * *